US005102001A

United States Patent [19]

Teague et al.

[11] Patent Number: 5,102,001

[45] Date of Patent: Apr. 7, 1992

[54] LID-TO-CONTAINER LOCKING ASSEMBLY

[75] Inventors: Lyndon M. Teague, Hampstead; Joey F. McCarter, Castle Hayne, both of N.C.

[73] Assignee: Container Products Corp., Wilington, N.C.

[21] Appl. No.: 634,611

[22] Filed: Dec. 27, 1990

[51] Int. Cl.[5] ..... B65D 45/16

[52] U.S. Cl. ..... 220/324; 220/214; 220/908

[58] Field of Search ..... 220/324, 908, 214; 292/288, 289, 300, 258, 256.5

[56] References Cited

U.S. PATENT DOCUMENTS 3,991,902 11/1976 Ford ..... 220/324
4,371,092 2/1983 Teague ..... 220/908 X
4,609,125 9/1986 Willingham ..... 220/324

FOREIGN PATENT DOCUMENTS 252108 9/1948 Switzerland ..... 220/324

*Primary Examiner*—Gary E. Elkins
*Assistant Examiner*—Paul A. Schwarz

[57] ABSTRACT

A lid-to-container locking assembly for lock sealing containers utilized in the transporting, storage and disposal of low level radioactive contaminated material. The locking assembly gives visual indications of a locked, sealed condition of the container through the utilization of a closure element that is ensconced in a latched position upon the lid to be secured, as well as to the container to be sealed. Detachment of the closure element at either of these points of its locking engagement with the lid and/or container will visually indicate an open and unsealed condition.

1 Claim, 2 Drawing Sheets

LID-TO-CONTAINER LOCKING ASSEMBLY

PRIOR ART DISCLOSURES

This invention is an improvement over the lid hold down assemblies shown and described in U.S. Pat. No. 4,371,092 and U.S. Pat. No. 4,625,891, and the art cited therein.

In some of the prior closure assemblies, the waste container looking system was utilized as a lasting closure means, and in others were used to seal the container while at the same time permitting unlocking of the closure systems so as to permit access into the container.

As these lid-to-container systems are designed as safety measures against the leaking or spillage of contaminated material during transportation, disposal and burial of the same, their construction and operation are subject to stringent Government regulations. Many of such containers utilized for the transportation and disposal of the contaminated material are subject to government prescribed drop tests, pressure tests, corner drop tests and stacking capabilities. The present invention was developed to meet and/or surface the known test criteria for such structures.

SUMMARY OF THE INVENTION

The object of the invention is to provide a lid-to-container locking and sealing system which is economical to manufacture, and one which will minimize the volume/cubic displacement ratio thus increasing the capacity of such containers during transportation and in storage.

The lid-to-container closure system of this invention includes a clip providing a locking element at each end of its body. These locking elements may be in the form of a reversed curved end edge, or a shoulder abutment carried on the face of the clip adjacent an end thereof. Both locking elements serve as catches that have physical contact with stirrup type retainers attached to the lid and the container respectively.

As both the clip and its retainer are of a size that requires a minimum of space and are disposed in minimal elevation from the lid and/or container their use will maximize the storage space available both horizontally and vertically.

DESCRIPTION OF THE DRAWING

This invention will best be understood by reference to the accompanying drawings which shows the preferred form of embodiment of the invention by which the stated objects thereof are achieved, and in which.

GENERAL DESCRIPTION OF THE INVENTION

The lid-to-container closure system of this invention is adapted for use upon a waste container which normally consists of a metallic box-like structure having a front and back wall and side walls extending vertically from a full bottom wall.

Figure 1:
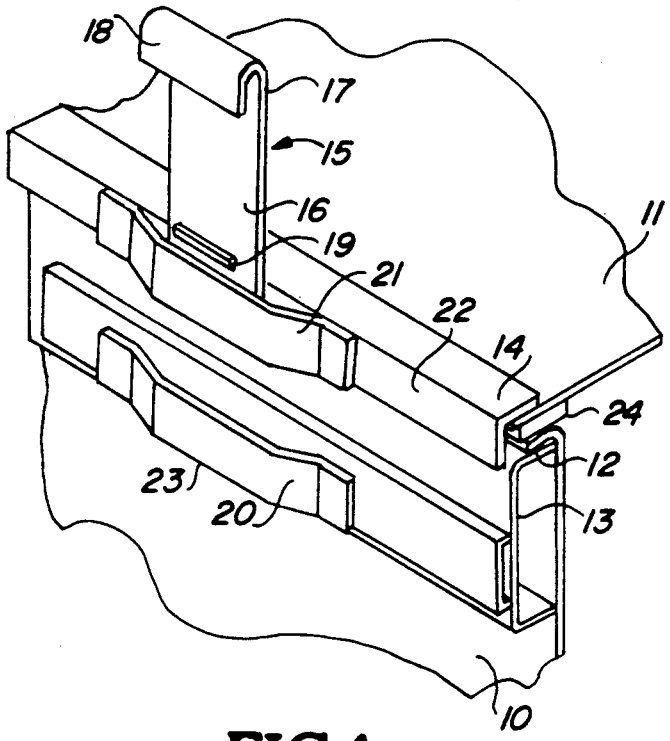
FIG. 1 is a perspective view of the lid-to-container locking assembly in a partial locked condition upon a fragmentarily shown lid and container.

In FIG. 1 a partial container wall 10 as well as a portion of a lid 11 in shown. The top exposed edges of the front, back and side walls of the container as illustrated by container wall 10 provide an outwardly directed flange 12, which are reinforced by a metallic channel shaped support rail 13.

The metallic lid 11 has its peripheral edges reinforced by an overlying angle iron 14. The size of the lid 11, together with its reinforcing angle iron 14 overlies the area defined by the reinforced exposed edges of the walls of the container.

Figure 3:
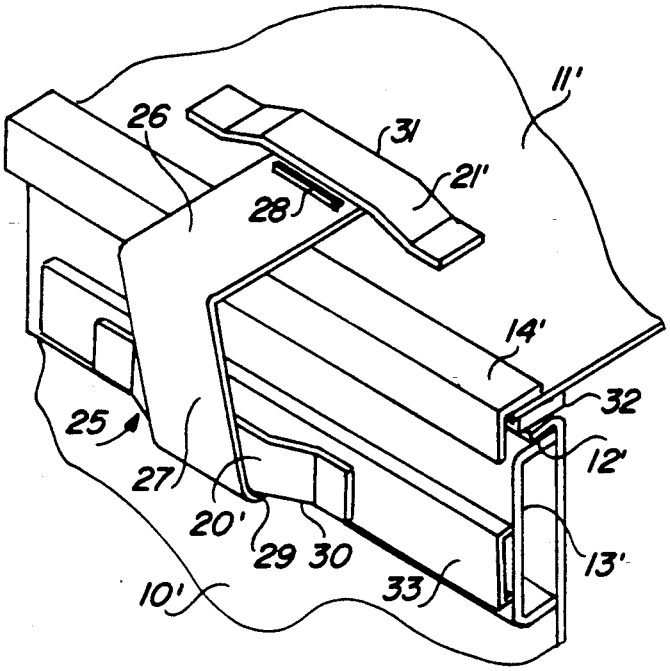
FIG. 3 is a perspective view of a modified lid-to-container locking assembly in an unlocked position.
Figure 4:
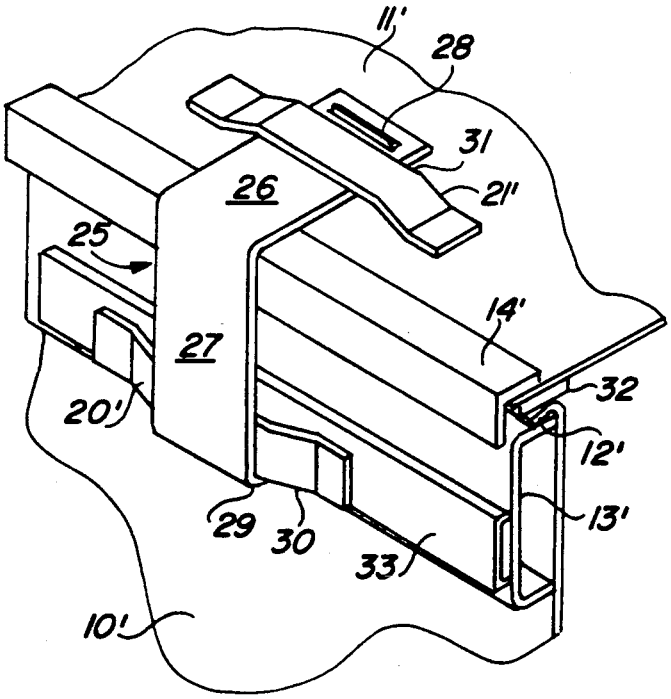
FIG. 4 is a perspective view of the modified lid-to-container closure system as shown in FIG. 3 in a fully locked condition.

The lid-to-container closure assembly of this invention utilizes a number of individual assemblies spaced about the container top maximizing the sealing and locking functions of such closure assemblies. One of such closure assembly is shown in each of the drawings, and each is identical in structure and operation, noting the modification as shown in FIGS. 3 and 4.

Figure 2:
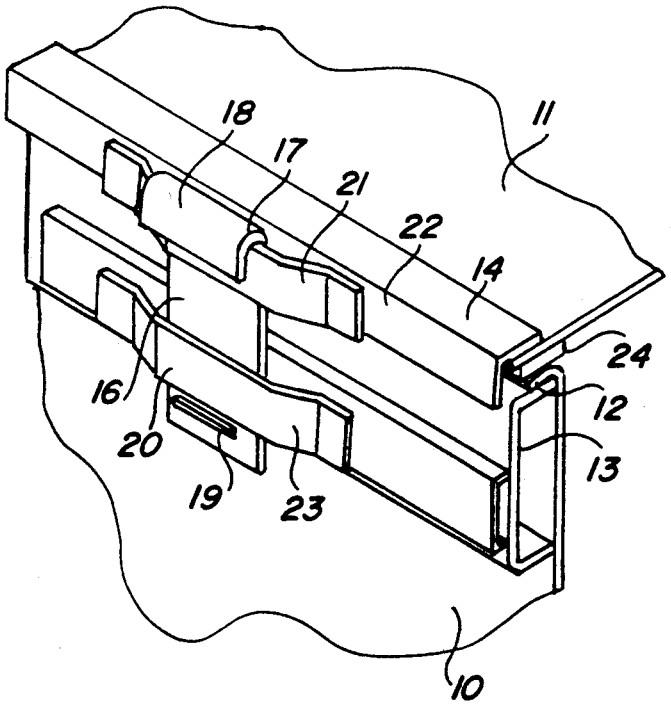
FIG. 2 is a perspective view of the lid-to-container locking assembly as shown in FIG. 1 in a fully locked position.

The lid-to-container closure assembly as shown in FIGS. 1 and 2 consists of a locking member 15 in the form of a straight strap 16 having its one end edge 17 reversely curved so as to provide a hook 18. Spaced from the hook 18 and on the same face of the strap 16 is a raised shoulder abutment 19.

The container wall 10 as well as the lid 11 have attached thereto retainers 20 and 21 in the form of stirrups. These retainers 20 and 21 are so disposed so as to be in parallel spaced relation, aligned so that the locking member 15 may be placed in operative relation thereto.

The stirrup 21 associated with the lid 11 is mounted on the vertical face 22 of the lid edge reinforcing flange 14. Thus as seen in FIGS. 1 and 2 the stirrups 20 and 21 are in a spaced relation lying in the same vertical plane.

To lock the lid 11 to the container wall 10 the locking member 15 must be forcibly moved through both retainers or stirrups 20 and 21 causing its hook 18 to engage its retainer 21 and the shoulder abutment 19 to pass beneath and engage the respective lower edge 23 of its retainer 20. To assist in the insertion of the strap 16 behind the retainers 20 and 21, the raised shoulder abutment 19 provides a tapered surface which acts as a cam when forced into contact with the retainers 20 and 21.

It should be noted that the length of the strap 16 from the bottom of the hook 18 to the shoulder abutment 19 is such that when it achieves its locked position, a sealing gasket 24 will be compressed against the flange 12 of the container wall 10 so as to seal the container.

The modified lid-to-container structure as shown in FIGS. 3 and 4 include, with the exception of its locking member 25, the identical structural elements as shown and described in FIGS. 1 and 2 therefore these elements will be identified by identical reference numbers primed. Thus in the modified illustration the container wall is 10' and lid is 11'.

The locking member 25 of the modified form consists of an angled clip that provides elongated legs 26 and 27. The leg 26 on its exposed face, adjacent to its end edge, provides a raised shoulder abutment 28. The end of the leg 27 is reversely bent to provide a hook-like element 29.

When using the locking member 25 as shown in FIGS. 3 and 4, the hook 29 on the end of the leg 27 is engaged with the bottom edge 30 of the retainer 20', while the leg 26 will be forced in a horizontal direction beneath the retainer 21' until the raised shoulder abutment 28 passes beyond and engages the furthermost edge 31 of the retainer 21'. To place the stirrup 20' in proper alignment with the edge of the lid 11' and its angle iron 14', a spacer member 33 is attached to the exposed face of the rail 13' as shown.

This fully locked position of the locking member 25 with the retainers 20' and 21' locks the lid 11' onto the container. It should be noted that the legs 26 and 27 of the locking member 25 are acutely angled such that when the leg 26 is forced into its locked position with respect to the retainer 21' to angular relation with respect to the leg 27 will force the reinforced edge of the lid 11' against, and compress, a sealing gasket 32 which in turn bears against the flange 12' of the container wall 10'.

From the foregoing it is apparent that there has been shown and described a lid-to-container closure assembly that achieves all of the stated objectives of the invention.

While there has been illustrated and described the preferred form of construction for carrying the invention into effect, this is capable of variations and modifications without departing from the spirit of the invention. The illustrations and descriptions should not be limited to the precise details as set forth but such variations and modification as come within the scope of the appended claims are to be available and incorporated into this invention.

Having thus described this invention what is claimed as new and desired to be protected by Letters Patent is:

1. A waste container including a lid-to-container closure assembly for securing and sealing the lid upon the container comprising:

a) an open top container;

b) a lid providing a flanged peripheral edge adapted to overlay the exposed edge of the open top container;

c) a stirrup-like retaining member mounted on a exposed wall of the container adjacent the open top thereof;

d) a second stirrup-like retaining member mounted on a side surface of said flanged peripheral edge of said lid in spaced vertical alignment with said stirrup-like retaining member mounted on said wall of said container;

e) a compressible sealing member positioned between said lid and said container, and f) locking means insertable through and behind said stirrup-like retaining members for securing and sealing said lid onto said container;

g) said locking means including fixed latching members adapted to latch onto said stirrup-like retaining members when said locking means is projected therethrough;

h) one of said fixed latching members comprising a generally inverted U-shaped hook element with the other of said fixed latching member comprising a raised shoulder abutment carried on one face of said locking means, with said fixed latching members so positioned relative to each other to latch onto said stirrup-like retaining members after said sealing member is compressed between said lid and said container.

* * * * *